United States Patent [19]

Bezsilko

[11] 4,108,187

[45] Aug. 22, 1978

[54] AUTOMATIC SORTER FOR PIECES OF MONEY OR SIMILAR OBJECTS AS A FUNCTION OF THEIR DIAMETER

[75] Inventor: Nicolas Bezsilko, Tourcoing, France

[73] Assignee: S. A. Vandeputte & Cie, Tourcoing, France

[21] Appl. No.: 682,375

[22] Filed: May 3, 1976

[30] Foreign Application Priority Data

Sep. 22, 1975 [FR] France ..... 75 29691

[51] Int. Cl.[2] ..... G07D 3/00

[52] U.S. Cl. ..... 133/3 A

[58] Field of Search ..... 133/3 R, 3 A, 3 C; 194/102

[56] References Cited

U.S. PATENT DOCUMENTS

| | | | |
|---|---|---|---|
| 1,799,785 | 4/1931 | Donnellan | 133/3 |
| 2,163,351 | 6/1939 | Paul | 133/3 R |
| 2,906,276 | 9/1959 | Blanchette et al. | 133/3 R |
| 2,977,961 | 4/1961 | Buchholz et al. | 133/3 R |

*Primary Examiner*—Robert B. Reeves
*Assistant Examiner*—Francis J. Bartuska
*Attorney, Agent, or Firm*—Cameron, Kerkam, Sutton, Stowell & Stowell

[57] ABSTRACT

A sorter for pieces of money feed the pieces onto a rotating disk and the various sizes are separated and received by fingers entering grooves in the disk spaced from the disk rim such that the pieces overhang the grooves corresponding to the diameter of the piece. A sorting track on the disk is interrupted by the grooves and the portion of the track at an internal edge of a groove is higher than that portion of the track on the external edge of the groove.

2 Claims, 1 Drawing Figure

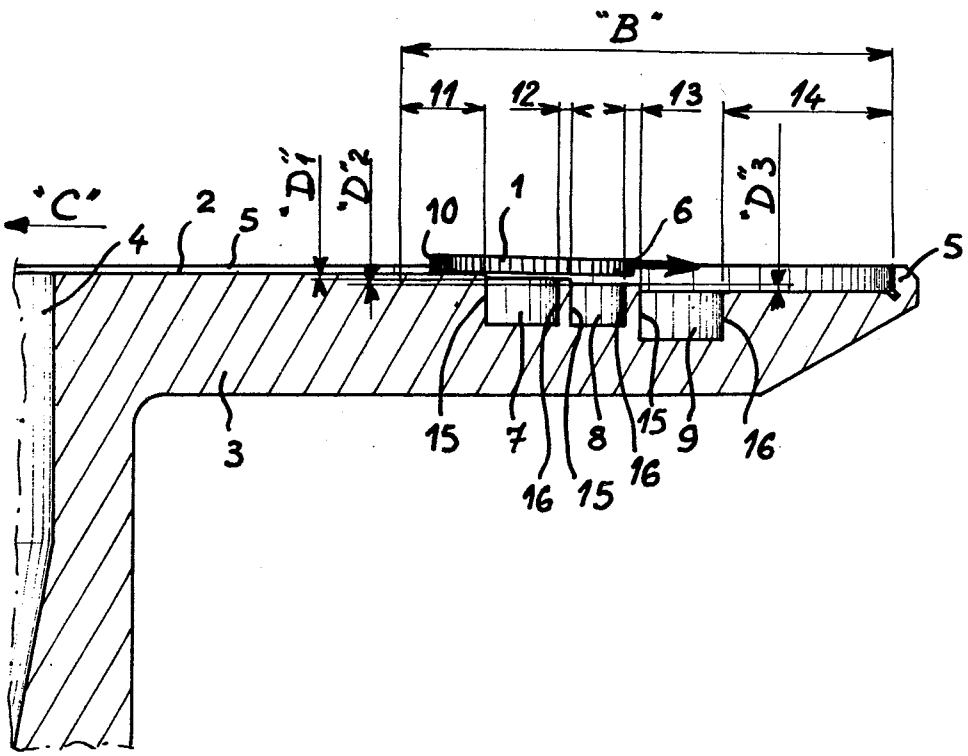
"B"
"C"
"D1"
"D2"
"D3"
1
2
3
4
5
6
7
8
9
10
11
12
13
14
15
16

AUTOMATIC SORTER FOR PIECES OF MONEY OR SIMILAR OBJECTS AS A FUNCTION OF THEIR DIAMETER

BACKGROUND OF THE INVENTION

The present invention relates to automatic sorting of pieces of money or similar pieces as a function of their diameter and the diameter can either be that of the pieces to be sorted, as in the case when the pieces are round or simply that of a circle inscribed in the pieces if the pieces are polygonal. More particularly the present invention relates to such a sorter comprising means for bringing pieces generally flat and one at a time, onto the top of a disk which is rotated and which has, on the one hand, a peripheral curb so that the pieces which, under centrifugal force, tend to leave the center of the disk come into edge contact with the curb, and, on the other hand, has at least one circular groove coaxial with the curb and situated at a distance with respect to the curb such that at least the pieces of a certain diameter have their edges, diametrically opposed to those bearing on the curb, overhanging the groove. At least one fixed finger enters the groove so that its forward extremity engages under the overhanging edges of the pieces which pieces, moved by the disk and guided by the top of the finger, are raised and then ejected from the curb by the kinetic forces that the pieces have absorbed.

On the top of the disk there is a circular band adjacent the curb which is usually called a sorting track or selective removal track. This circular band extends radially towards the center of the disk on a path at least slightly greater than the diameter of the largest of the pieces to be sorted. Further, in view of the circular grooves in the disk, this track is in fact formed of several coaxial track portions.

In all the sorters, of the above type, known at the present time, and as shown in U.S. Pat. No. 2,906,276 of Sept. 29, 1959, when they are seen in axial cross-section, these portions of track are all situated on the same straight line. This is true when the disk has a flat track or slightly truncated track and this is also well known. Further, in these sorters, nothing prevents a slight return of the pieces toward the center and the raising of pieces by a finger other than that corresponding to their diameter resulting in a sorting error this return occuring during normal use as by rebounding on the curb or by slow speed or by a stoppage by an exterior intervention.

On the other hand, since the grooves receive the forward end of at least a fixed finger and with play and since each finger should be sufficiently thick to offer the desired resistance, each groove is necessarily relatively wide, notably with respect to the small diameter of certain pieces.

The forward part of the pieces, that is their part turned toward the curb, obviously arrive at a precise moment overhanging this wide groove. At this moment the trajectory of the piece and particularly if it is a piece of small diameter, can, by the play of the weight and also by the resistance to the sliding of the piece on the track, be deflected lightly inwardly.

The portion of the track following the groove being at the same level as the portion which precedes it, it follows then that because of the very small inflection of its trajectory, a piece comes into engagement on the top of the lateral external face of the groove without being able to move directly to the curb. This results in a disturbance of the arrangement of the pieces and a sorting error.

BRIEF DESCRIPTION OF THE INVENTION

It is an object of the present invention to provide a sorter on the track of which the pieces move to the curb without risk of engagement on the lateral faces of the grooves.

Another object of the present invention is a sorter in which the track prevents the pieces from returning toward the center of the disk.

The present invention has for its object a sorter of the general type described above characterized in that, when the track is seen in axial cross-section each groove being defined by an internal edge and an external edge respectively situated toward the center and toward the curb of the disk, the portion of the track adjacent the internal edge of the groove is situated at a level at least slightly higher than that of an imaginary extension of that portion of the track adjacent the external edge of the same groove.

BRIEF DESCRIPTION OF THE DRAWING

The present invention will be described hereinafter by way of nonlimiting example with respect to the accompanying drawing which shows the disk of a sorter in axial cross-section and on large scale.

DESCRIPTION OF A PREFERRED EMBODIMENT

The sorter includes means as generally shown in the patent referred to above to bring in flat and one after another pieces 1 on top 2 of the disk 3. This means can be located above the disk or in a central opening of the disk 4. Disk 3 is rotated by any suitable known means as shown in this patent. The disk has a peripheral curb 5 so that the pieces 1, which under centrifugal force tend to move from center "C" of the disk have, their edges 6 brought into engagement with curb 5.

Disk 3 also has one or more circular grooves 7, 8, 9 coaxial with curb 5 and located with respect to curb 5 at distances such that when the pieces engage against curb 5 edges 10 of the pieces diammetrically opposed to edge 6 bearing on curb 5 overhang one of grooves 7, 8, 9. Fixed fingers as shown in this patent extend into the grooves in number equal to the number of diameters of pieces to be sorted. The forward extremity of each piece of diameter corresponding to the distance of the finger will move under the overhanging edge of each piece of diameter corresponding to the distance of the finger from curb 5. The top of each finger forms a ramp and disengages and guides the raising of the piece moved by the disk with final ejection of piece 1 from curb 5 under the action of the kinetic energy absorbed by the piece.

On the top 2 of the disk 5, circular band B which nears the curb 5 is called the sorting track or track for selective ejection. It extends radially toward the center C of the disk 5 on a width greater than the diameter of the largest of the pieces to be sorted. Because of grooves 7, 8, 9, this track is in reality composed of several coaxial portions of track 11, 12, 13 and 14.

In accordance with an essential characteristic of the present invention, track B in axial section at each groove 7, 8, 9 has on the side of center C of disk 3 an internal edge 15 and on the curb 5 side of the disk 3 an external edge 16. The portion of track, respectively 11, 12 or 13, adjacent internal edge 15 is located at a level higher than that of an imaginary extension of a portion of the track, respectively 12, 13 or 14, adjacent the external edge 16 of the groove 7, 8, or 9.

The successive downward steps D1, D2, D3 are at least sufficient to compensate for possible inflections of the radial component of the trajectory of the pieces preventing the pieces from engaging on the external edges 16 of the grooves 7, 8 and 9. The internal edges 15 of grooves 7, 8 and 9 form stops preventing any return of the pieces toward the center C of disk 3.

It is obvious that the portions of track 11, 12, 13, 14 can be flat or conical depending on whether they are formed by the revolution of cutters perpendicular or oblique with respect to the axis of the disk.

What I claim is:

1. In an automatic sorter for pieces of money and similar objects having a rotating disc, an upper surface for said disc, at least one circular groove in said upper surface, an internal edge for said groove located on the side of the center of said disc, an external edge for said groove located on the side of the periphery of said disc, said groove dividing the upper surface of said disc into several portions on which the pieces of money are displaced sliding flat under the action of centrifugal force resulting from the rotation of said disc moving the pieces of money from the center of the disc, the improvement comprising, when said disc is seen in axial cross-section, a portion of said surface adjacent said internal edge of said groove being at a level at least slightly higher than that of a portion of said surface adjacent said external edge of said groove whereby the pieces of money are prevented from engaging said external edge of the groove and also whereby said internal edge of the groove prevents the pieces of money from returning towards the center of the disc.

2. A sorter as described in claim 1 the improvement in which the coaxial portions of the track are flat surfaces obtained by rotation around parallel straight portions.

* * * * *